US005263658A

United States Patent [19]

Baucom et al.

[11] Patent Number: 5,263,658

[45] Date of Patent: Nov. 23, 1993

[54] SPOOLED ROPE DISPLAY AND DISPENSING RACK

[75] Inventors: William E. Baucom, Canton, Ohio; Robert Monk, Madison, Ga.

[73] Assignee: Wellington Leisure Products, Inc., Madison, Ga.

[21] Appl. No.: 956,270

[22] Filed: Oct. 5, 1992

[51] Int. Cl.[5] ..... B65H 49/32

[52] U.S. Cl. ..... 242/129.62; 242/129.5; 312/133

[58] Field of Search ..... 242/129.6, 129.62, 129.5, 242/130, 131, 129, 139, 141; 312/133; 211/162, 163, 95, 45

[56] References Cited

U.S. PATENT DOCUMENTS

| | | | |
|---|---|---|---|
| 244,017 | 7/1881 | Zeigler | 242/129.6 |
| 935,095 | 9/1909 | Dodge | 312/133 |
| 991,164 | 5/1911 | Miller | 312/133 |
| 1,022,077 | 4/1912 | Haas | 242/129.62 |
| 1,332,081 | 2/1920 | Talley et al. | 312/133 |
| 1,492,944 | 5/1924 | Talley et al. | 312/133 |
| 1,848,744 | 3/1932 | Pavlas | 242/129.6 |
| 2,204,502 | 6/1940 | Krauss | 312/133 |
| 2,891,739 | 6/1959 | Wolfe | 242/110 |
| 3,275,263 | 9/1966 | Parkinson | 242/129 |
| 3,425,564 | 2/1969 | Allsop | 211/37 |
| 3,827,654 | 8/1974 | Armstrong | 242/146 |
| 3,915,406 | 10/1975 | Rolli et al. | 242/131 |
| 4,247,010 | 1/1981 | Eckert | 211/131 |
| 4,367,852 | 1/1983 | Lazaro, Jr. | 242/129 |
| 4,385,738 | 5/1983 | McDonald | 242/129.6 |
| 4,537,106 | 8/1985 | Rider | 242/129.62 X |
| 4,572,458 | 2/1986 | Bluhm et al. | 242/131 |
| 4,591,109 | 5/1986 | Kremer | 242/129.62 X |

*Primary Examiner*—Stanley N. Gilreath
*Attorney, Agent, or Firm*—Kennedy & Kennedy

[57] ABSTRACT

A rack (10) for displaying and dispensing spools of rope one behind the other in limited spaces. The rack has a base (13), a plate (12) reciprocally mounted to the base, and a frame (11) pivotably mounted to the plate. The frame includes rods (22) for rotatably mounting spools of rope one behind the other.

5 Claims, 2 Drawing Sheets

SPOOLED ROPE DISPLAY AND DISPENSING RACK

TECHNICAL FIELD

This invention relates to racks for displaying and dispensing spooled rope, and particularly to such type racks for use in confined spaces.

BACKGROUND OF THE INVENTION

Rope has long been stored, displayed and dispensed in retail stores on spools rotatably supported on racks. Spools have been displayed on tree-like racks having a central support and several spool support rods extending from opposite sides of the central support. However, as rope is depleted from the spools on one side of the rack they often became unbalanced causing them to have the tendency of toppling over.

Racks have also been used that have two juxtaposed rods on which a spool is supported with its end flanges rotatably nested between the rods. A problem encountered with this design is that light spools of rope tend to ride over the forward rod as they are rotated. Also, as the flanges of the spools wear with use, they become more difficult to rotate.

Racks have also been designed that have a frame which supports several elongated rods one above the other. Each rod is journaled through a spool of rope so as to rotate about the rod. The frame of these racks typically has a depth slightly larger than the diameter of the spool. With these, stores having deep shelf widths experience the lost of valuable shelf space due to the depth of the rack being substantially smaller than the width of the shelf. This difference causes a large portion of the shelf to remain vacant due to the impracticability of displaying merchandise in front of or behind the racks.

It thus is seen that a need remains for a rack for displaying and dispensing spooled rope in a more space efficient manner. It is to the provision of such that the present invention is primarily directed.

SUMMARY OF THE INVENTION

In a preferred form of the invention, a rack for displaying and dispensing spooled rope within a limited space comprises a base and a frame having rods for rotatably mounting at least two spools of rope one behind the other. The frame has a plate mounted to the base for reciprocal movement thereon, and an annular bearing for pivotably mounting the frame to the plate. With this construction, the frame of a rack located upon a shelf close to a shelf supporting wall may be rotated to display spooled rope from either side of the frame by moving the frame away from the wall to allow clearance between the frame and the wall as the frame is rotated and then returned to its position close to the wall.

DETAILED DESCRIPTION

Figure 1:
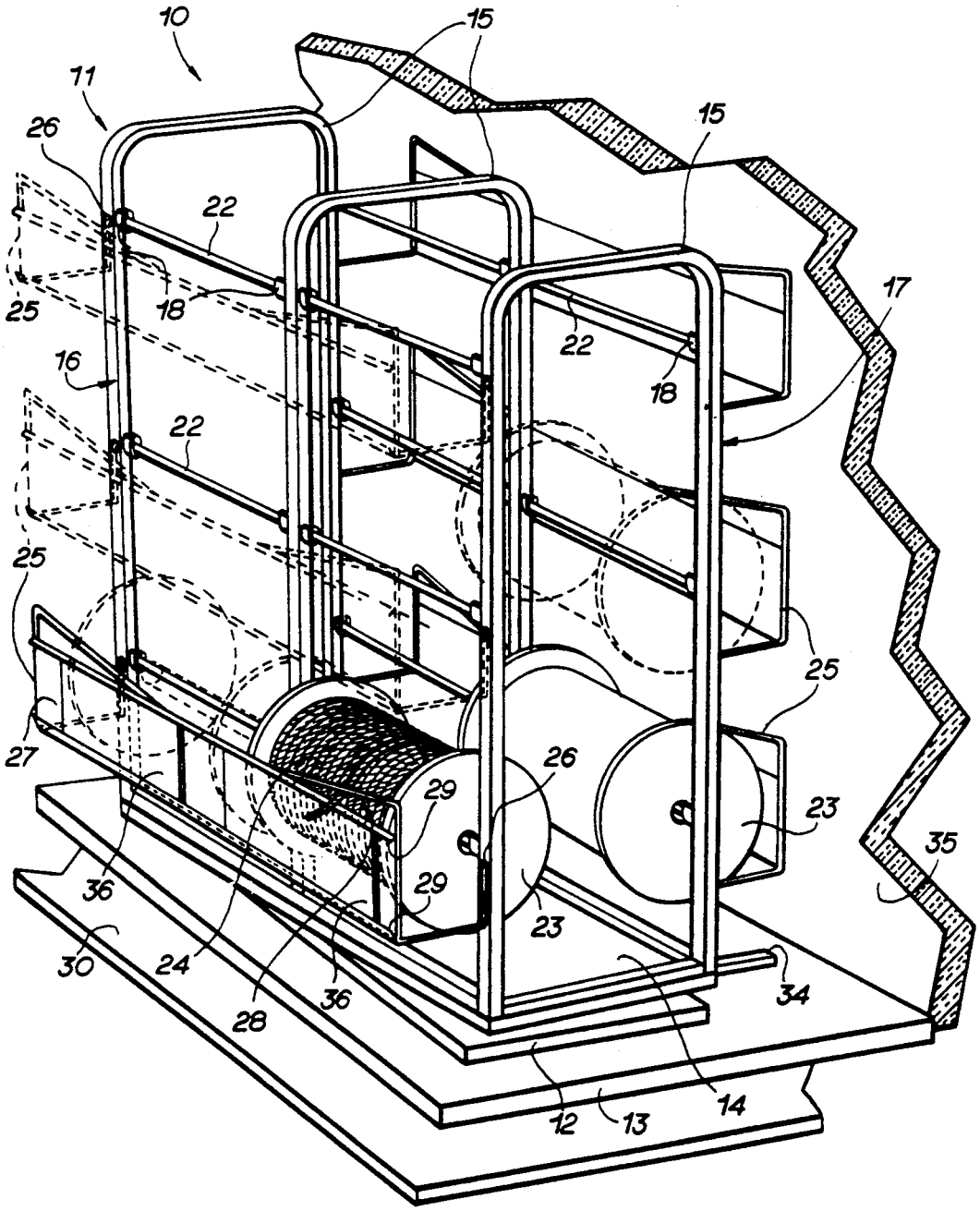
FIG. 1 is a perspective view of a rack embodying principles of the invention is a preferred form with portions of the rack shown in phantom lines for clarity.

With reference next to the drawing, there is shown in FIG. 1 a rack 10 having a rectangular base 13, a rectangular plate 12 reciprocally mounted upon the base 13, and a frame 11 pivotably mounted upon the plate 12. The frame 11 has a flooring 14 on which is mounted three, generally parallel, inverted U-shaped stanchions 15, each having a front side 16 and a back side 17. Twelve pairs of U-shaped brackets 18 are mounted to the stanchions to receive and removably hold a rod 22. Three rope holders 25 are mounted to both the front side 16 and the back side 17 of the stanchions. The rope holders 25 have ends which extend through holes 26 in the outermost stanchions so as to removably mount the holders 25 to the stanchions. Each rope holder 25 has a rectangular, front portion 27 having inturned top and bottom flanges 29 and a V-shaped channel 28 therein.

Figure 2:
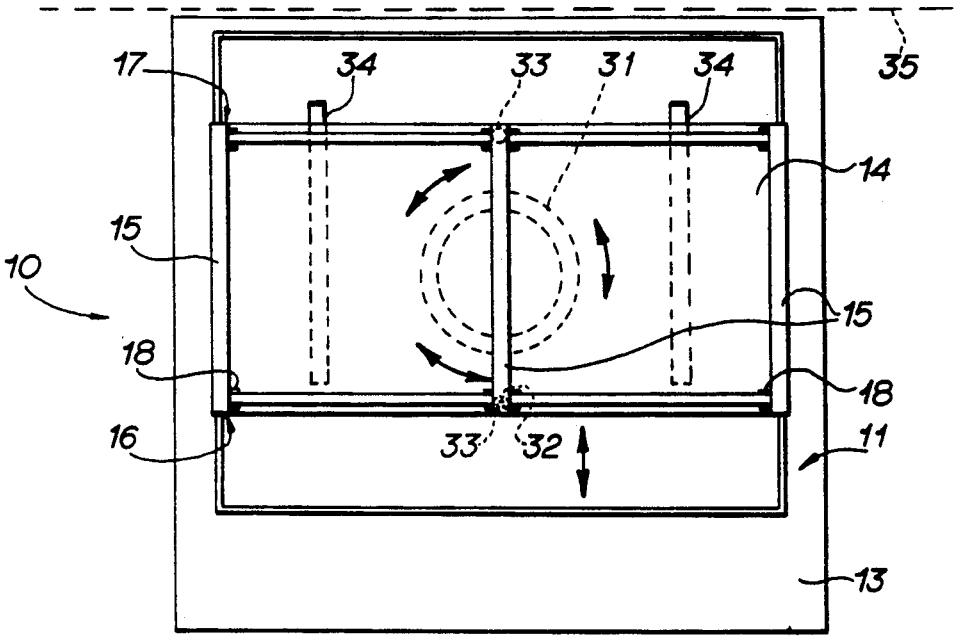
FIG. 2 is a top plan view of the rack of FIG. 1.
Figure 3:
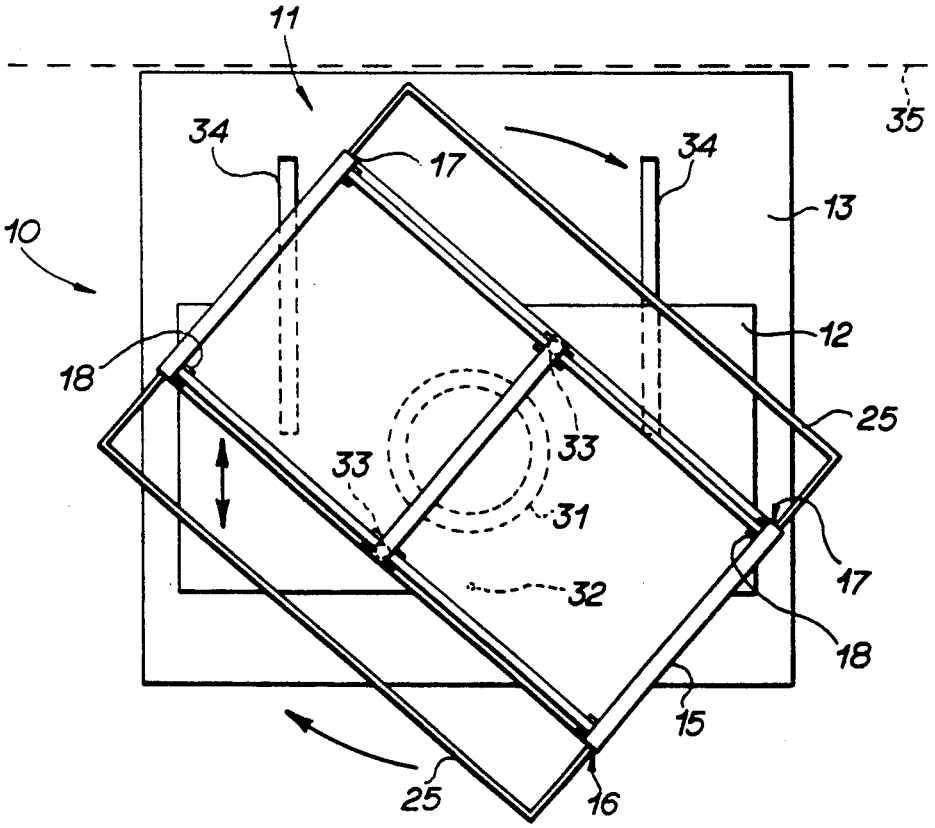
FIG. 3 is a top plan view of the rack of FIG. 1 shown being rotated.

As shown in FIGS. 2 and 3, an annular bearing 31 is mounted between the frame flooring 14, and the plate 12 for use in pivotably moving the frame 11 upon the plate. A spring loaded detent 32 is mounted to plate 12 which releasibly holds the frame in a forward and rearward facing position. The detent 32 is sized and shaped to be received in holes 33 extending into the underside of the frame flooring 14. Two bearing rails 34 are mounted between the plate 12 and the base 13 for reciprocally moving the plate upon the base between a rearward plate position, as shown in FIG. 2, and a forward plate position, as shown in FIG. 3.

In use, each rod 22 of the frame is journaled through a spool 23 having a length of rope 24 wound thereon. An information card 36, containing information pertaining to each adjacent spool of rope, such as its preferred use, composition and characteristics, is mounted to portion 27 adjacent each spool. The end of each rope 24 is squeezably held within an adjacent V-shaped channel 28 above it information card 36. The rack 10 is positioned within a space with the base 13 resting upon a flooring 30 of the space closely adjacent a rear wall 35 of the space and the front side 16 of the frame facing forward away from the wall 35. With the frame in this position a customer may view the six spools of rope mounted to the front side 16 of the stanchions along with their accompanying information cards 36.

To view rope displayed on spools mounted to the back side 17 of the stanchions the plate 12 is moved along bearing rails 34 to its forward position. The frame 11 is then rotated 180° in either direction upon the annular bearing 31 to a position where the back side 17 of the stanchions is facing forward with the spools of rope mounted to the back side 17 of the stanchions in plain view. The detent 32 is received within hole 33 adjacent the back side of the stanchions so that the frame is releasibly held in this position. The plate 12 may then be returned along bearing rails 34 to its initial, rearward position.

The plate is moved forward to allow clearance between the frame 11 and the rear wall 35 as the frame is rotated. If desired, the frame may again be rotated in either direction to view the spools of rope mounted to the front side of the stanchions in the same manner as previously described.

Rope may be dispensed from a spool by moving the end of the rope into the larger portion of the adjacent V-shaped channel 28 so that the rope is unrestrained by the rope holder. The rope is then unspooled by pulling it through the channel, thereby causing the spool to rotate upon the rod. Once the desired length of rope is played out it is severed and the end of the spooled rope is again squeezed into the narrower portion of the channel.

An empty spool may be removed and replaced with a full spool of rope by removing the rope holder 25 in front of the spool and moving the rod 22 bearing the empty spool from brackets 18. The empty spool is then removed from the rod and replaced with a full spool. The rod is then remounted upon the brackets and the rope holder remounted upon the stanchion. If the replacement rope is of a different type than the initial rope a new information card 36 is attached to the rectangular portion 27 of the rope holder.

With this rack construction shelf space is used to a maximum by displaying rope on spools mounted in two rows, one behind the other, as opposed to prior racks wherein the spools were mounted one deep. This construction may also restrict encroachment of the rack into an aisle forward of the shelf to those brief instances when the rack is being rotated.

From the foregoing it is seen that a rack for displaying and dispensing spooled rope is now provided which overcomes problems long associated with those of the prior art. It should be understood however that the just described embodiment merely illustrates principles of the invention in its preferred form. Many modifications, additions and deletions may, of course, be made thereto without departure from the spirit and scope of the invention as set forth in the following claims.

We claim:

1. A rack for displaying and dispensing spooled rope within a limited space having a flooring or shelf and a rear wall, and with the rack comprising a base plate having an upper surface, two bearing rails mounted to said base plate upper surface, a frame support plate mounted to said bearing rails for reciprocal movement of said frame support plate above and relative to said base plate, a frame having a floor and means for rotatably mounting at least two spools of rope one behind the other, and pivot means pivotably mounting said frame floor to said frame support plate whereby with the rack positioned on a flooring close to a rear wall of a limited space its frame may be rotated to display spooled rope from either side of the frame without the frame striking the rear wall by moving the frame away from the wall to allow clearance between the frame and the rear wall as the frame is rotated and then returned to its position close to the wall.

2. The rack of claim 1 wherein said frame floor is mounted closely adjacent said frame support plate and said frame support plate is mounted closely adjacent said base plate.

3. The rack of claim 1 further comprising detent means for releasibly maintaining said frame in selected rotary positions.

4. The rack of claim 1 wherein said pivot means comprises an annular bearing.

5. The rack of claim 1 further comprising a plurality of rope holding means for releasibly holding ends of spooled ropes supported upon said frame.

* * * * *